US011952764B2

(12) United States Patent
Tone et al.

(10) Patent No.: US 11,952,764 B2
(45) Date of Patent: Apr. 9, 2024

(54) FLUSH TOILET

(71) Applicant: TOTO LTD., Kitakyushu (JP)

(72) Inventors: Yusuke Tone, Fukuoka (JP); Masaaki Momoe, Fukuoka (JP); Eiji Shiohara, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/889,414

(22) Filed: Aug. 17, 2022

(65) Prior Publication Data

US 2023/0064176 A1 Mar. 2, 2023

(30) Foreign Application Priority Data

Aug. 27, 2021 (JP) ..... 2021-139265
Jan. 28, 2022 (JP) ..... 2022-012250

(51) Int. Cl.
*E03D 11/02* (2006.01)
*E03D 1/14* (2006.01)

(52) U.S. Cl.
CPC ..... *E03D 11/02* (2013.01); *E03D 1/14* (2013.01)

(58) Field of Classification Search
CPC ..... E03D 11/02; E03D 1/14
USPC ..... 4/300
See application file for complete search history.

(56) References Cited

U.S. PATENT DOCUMENTS 11,739,518 B2 * 8/2023 Shiohara ..... E03D 11/13 4/420
2009/0255050 A1 * 10/2009 Lebrun ..... A47K 3/161 4/584
2022/0316197 A1 * 10/2022 Shiohara ..... E03D 11/13
2022/0316199 A1 * 10/2022 Shiohara ..... E03D 11/13
2022/0316200 A1 * 10/2022 Shiohara ..... E03D 11/13
2023/0061790 A1 * 3/2023 Tone ..... E03D 11/02

FOREIGN PATENT DOCUMENTS

JP 2020-165173 10/2020
JP 7124915 B1 * 8/2022 ..... E03D 11/13
JP 7124916 B1 * 8/2022 ..... E03D 11/02

* cited by examiner

*Primary Examiner* — Lori L Baker
(74) *Attorney, Agent, or Firm* — Amin, Turocy & Watson, LLP

(57) ABSTRACT

A flush toilet according to embodiments includes: a toilet body, a function unit, a panel member, and a holding part. The function unit is arranged in a rear part of the toilet body. The panel member covers a side surface of the function unit. The holding part causes the toilet body and a side surface of the panel member to attract and hold to each other by using magnetic force. In a state where being attached to the toilet body, the panel member is formed to be curved toward the toilet body. The holding part is formed such that an attraction surface of a panel-side magnetic material that is provided to the panel member and an attraction surface of a body-side magnetic material that is provided to the toilet body are formed in plane-shaped.

6 Claims, 9 Drawing Sheets

FLUSH TOILET

CROSS-REFERENCE TO RELATED APPLICATIONS

The present application claims priority to and incorporates by reference the entire contents of Japanese Patent Application No. 2021-139265 filed in Japan on Aug. 27, 2021 and Japanese Patent Application No. 2022-012250 filed in Japan on Jan. 28, 2022.

FIELD

Embodiments of the disclosure relate to a flush toilet.

BACKGROUND

Conventionally, in a flush toilet whose function unit is covered by a panel member, there has been known a technology that employs magnetic force in order to attach and hold the panel member to a toilet body (see Japanese Laid-Open Patent Publication No. 2020-165173, for example).

Incidentally, in the above-mentioned flush toilet, for example, a side surface of a panel member is formed in curve-shaped in some cases, in order to improve design and usability thereof. However, in the conventional technology, if the panel member is formed in curve-shaped, an attraction surface of a magnetic material provided to the panel member is also curved, the panel member is not appropriately in contact with an attraction surface of a magnetic material provided to the toilet body and thus holding force with respect to the panel member decreases in some cases, so that there presents possibility of falling off of the panel member. Moreover, if an attraction surface of the magnetic material is curved as described above, a panel member is hard to slide in a state where the panel member is held to a toilet body, so that positioning of the panel member becomes difficult.

SUMMARY

A flush toilet according to one aspect of embodiments includes: a toilet body; a function unit that is arranged in a rear part of the toilet body; a panel member that covers a side surface of the function unit; and a holding part that causes the toilet body and a side surface of the panel member to attract and hold to each other by using magnetic force, wherein in a state where being attached to the toilet body, the panel member is formed to be curved toward the toilet body, and the holding part is formed such that an attraction surface of a panel-side magnetic material that is provided to the panel member and an attraction surface of a body-side magnetic material that is provided to the toilet body are formed in plane-shaped.

The above and other objects, features, advantages and technical and industrial significance of this invention will be better understood by reading the following detailed description of presently preferred embodiments of the invention, when considered in connection with the accompanying drawings.

DESCRIPTION OF EMBODIMENTS

Hereinafter, details of embodiments of a flush toilet according to the present application will be specifically explained with reference to the accompanying drawings. Note that the present disclosure is not limited to the embodiments described hereinafter. The drawings are schematic, and thus note that relation between sizes of elements, a ratio between the elements, and the like may be different from those in reality. Between the drawings, there may be also present a case where a part is included whose relation or ratio between the sizes are different from each other.

First Embodiment

Figure 1:
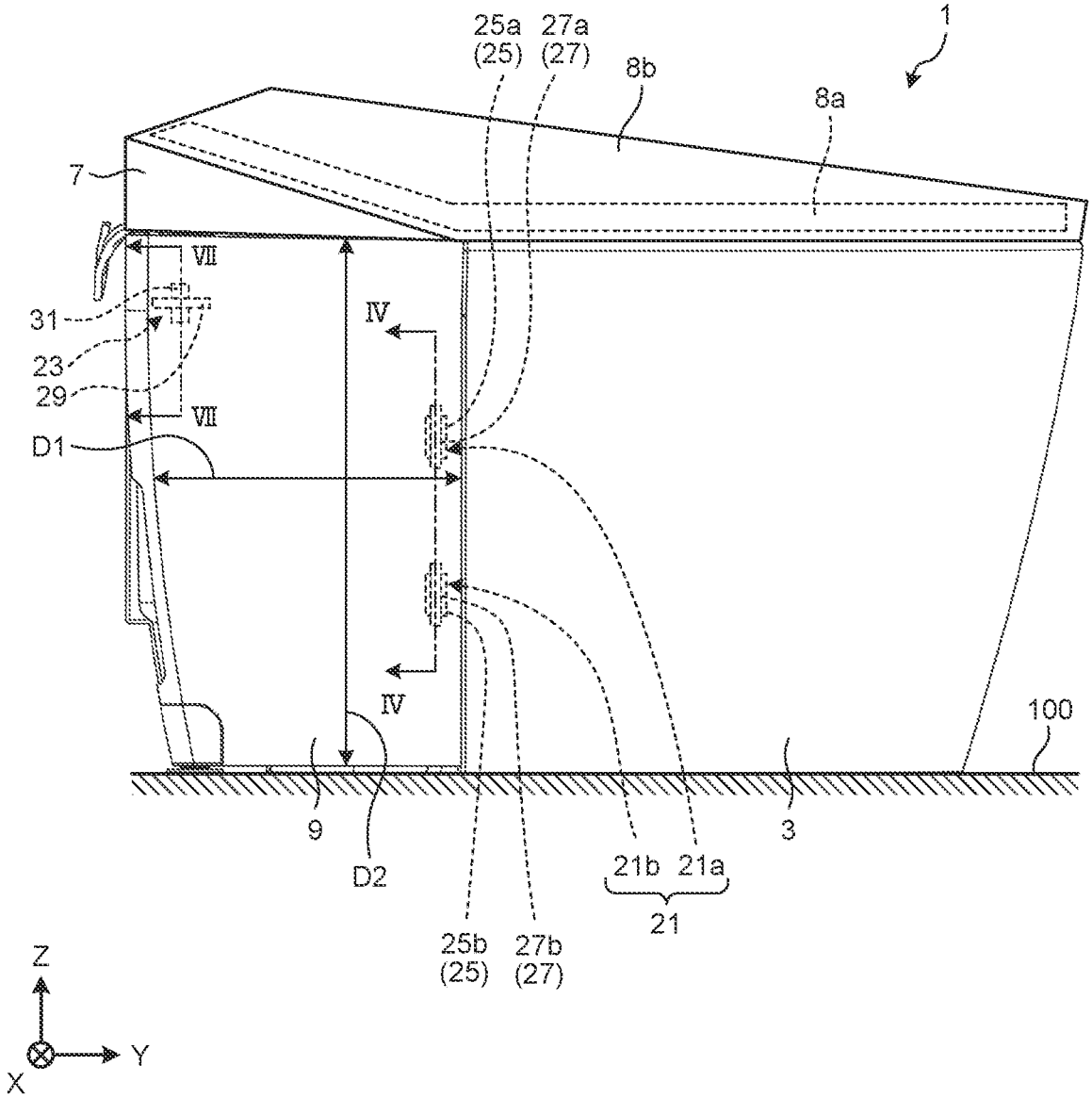
FIG. 1 is a side view illustrating a flush toilet according to a first embodiment.
Figure 2:
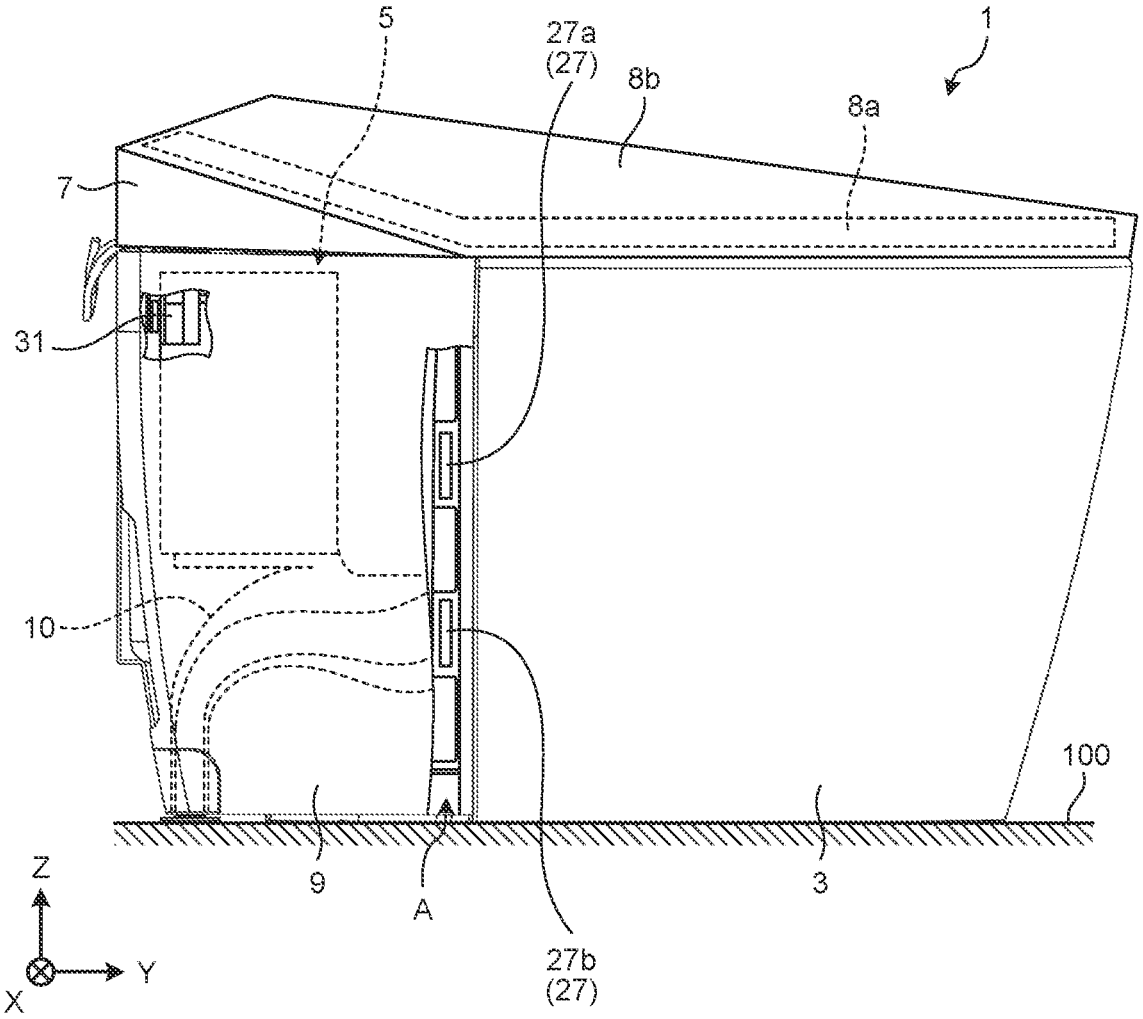
FIG. 2 is a side view illustrating the flush toilet from which a part of a panel member is omitted.

An overall configuration of a flush toilet 1 according to a first embodiment will be explained with reference to FIGS. 1 and 2. FIG. 1 is a side view illustrating the flush toilet 1 according to the first embodiment. FIG. 2 is a side view illustrating the flush toilet 1 from which a part of a panel member 9 is omitted.

In FIGS. 1 and 2, for convenience of explanation, a three-dimensional orthogonal coordinate system including a Z-axis whose positive direction is the vertical direction (upward) is illustrated. The above-mentioned orthogonal coordinate system may be illustrated in other drawings. In the above-mentioned orthogonal coordinate system, the positive direction of a Y-axis is prescribed as a front direction, the negative direction of the Y-axis is prescribed as a reverse direction, the positive direction of an X-axis is prescribed as a left direction, and the negative direction of the X-axis is prescribed as a right direction. Thus, in the following explanation, an X-axis direction may be referred to as a left-right direction, a Y-axis direction may be referred to as a front-back direction, and a Z-axis direction may be referred to as an up-and-down direction.

The flush toilet 1 according to the present embodiment is a flush toilet that is arranged on a floor surface 100, which is a so-called floor-placed flush toilet. Note that the flush toilet 1 may be a so-called wall-mounted flush toilet that is mounted on a not-illustrated wall surface.

As illustrated in FIGS. 1 and 2, the flush toilet 1 includes a toilet body 3, a function unit 5, a sanitary washing device 7, and the panel member 9. The toilet body 3 is made of pottery, for example. Note that the toilet body 3 is not limitedly made of pottery, and may be made of resin or may be made of combination of pottery and resin, for example.

The toilet body 3 includes a bowl part (not illustrated) and a drainage water trap pipeline 10 (see FIG. 2). The bowl part is formed in bowl-shaped to be able to receive a waste. On an upper periphery of the bowl part, a rim part is formed, flush water is spouted from a rim water spout port (not-illustrated) of the above-mentioned rim part so as to wash the bowl part. The flush water having washed the bowl part is discharged via the drainage water trap pipeline 10.

As illustrated in FIG. 2, the function unit 5 is arranged in a rear part of the toilet body 3. For example, the function unit 5 has function of supplying water to the bowl part of the toilet body 3 and the sanitary washing device 7. For example, the function unit 5 includes a water storage tank (not-illustrated), a pressure pump (not illustrated), and the like so as to cause the pressure pump to pressurize flush water stored in the water storage tank, and spouts the pressurized flush water from a jet water spout port (not illustrated) to the bowl part at a large flow volume.

The sanitary washing device 7 is arranged in an upper part of the toilet body 3 so as to include a toilet seat part 8*a*, a lid part 8*b* that covers the toilet seat part 8*a*, a not-illustrated nozzle device, and the like. The sanitary washing device 7 ejects washing water from the above-mentioned nozzle device toward a body of a user to be able to wash a private part thereof. In the above mentioned, the sanitary washing device 7 has a sanitary washing function; however, not limited thereto, the sanitary washing device 7 may have, for example, a drying function for blowing warm air to a bottom of a user sitting on the toilet seat part 8*a* so as to dry the bottom, a toilet-seat heating function for appropriately heating a seating surface of the toilet seat part 8*a*, and the like.

The panel member 9 is arranged in the rear part of the toilet body 3 so as to cover a side surface of the function unit 5 (see FIG. 2). By employing the panel member 9, it is possible to prevent external damage and/or intrusion of sewage to the function unit 5. Note that the panel member 9 is made of resin, for example; however, not limited thereto.

The panel member 9 is attached and held to the toilet body 3 by using magnetic force. In a case where being attached to the toilet body 3 and being positioned with respect to the toilet body 3 (positional adjustment is executed), the panel member 9 according to the present embodiment is configured such that the panel member 9 is capable of sliding with respect to the toilet body 3 and/or the function unit 5 in the front-back direction indicated by using an arrow D1 and the up-and-down direction indicated by using an arrow D2 that are illustrated in FIG. 1, for example; this point will be mentioned later.

Next, details of a configuration related to attachment between the panel member 9 and the toilet body 3 will be explained.

The flush toilet 1 includes first holding parts 21 and a second holding part 23. The toilet body 3 and a side surface of the panel member 9 are attracted and held by the first and second holding parts 21 and 23 by using magnetic force. Specifically, a side surface of the toilet body 3 and a side surface of the panel member 9 are attracted and held by the first holding parts 21 by using magnetic force. A side surface of the function unit 5 arranged in the rear part of the toilet body 3 and a side surface of the panel member 9 are attracted and held by the second holding part 23 by using magnetic force.

The first holding parts 21 will be explained, the first holding parts 21 are arranged in a boundary portion A (see FIG. 2) between the toilet body 3 and the panel member 9. The boundary portion A is a part in which the toilet body 3 and the panel member 9 are overlapped with each other when the panel member 9 is appropriately arranged on the toilet body 3.

As illustrated in FIG. 1, the first holding parts 21 includes an upper holding part 21*a* and a lower holding part 21*b*. In a state where the panel member 9 is attached to the toilet body 3, the upper holding part 21*a* is in an upper portion, and the lower holding part 21*b* is in a portion that is lower than the upper holding part 21*a*.

Hereinafter, in a case where the upper holding part 21*a* and the lower holding part 21*b* are explained while not differentiating therebetween, each of them may be referred to as "first holding part 21". The first holding part 21 is one example of a holding part.

Figure 3:
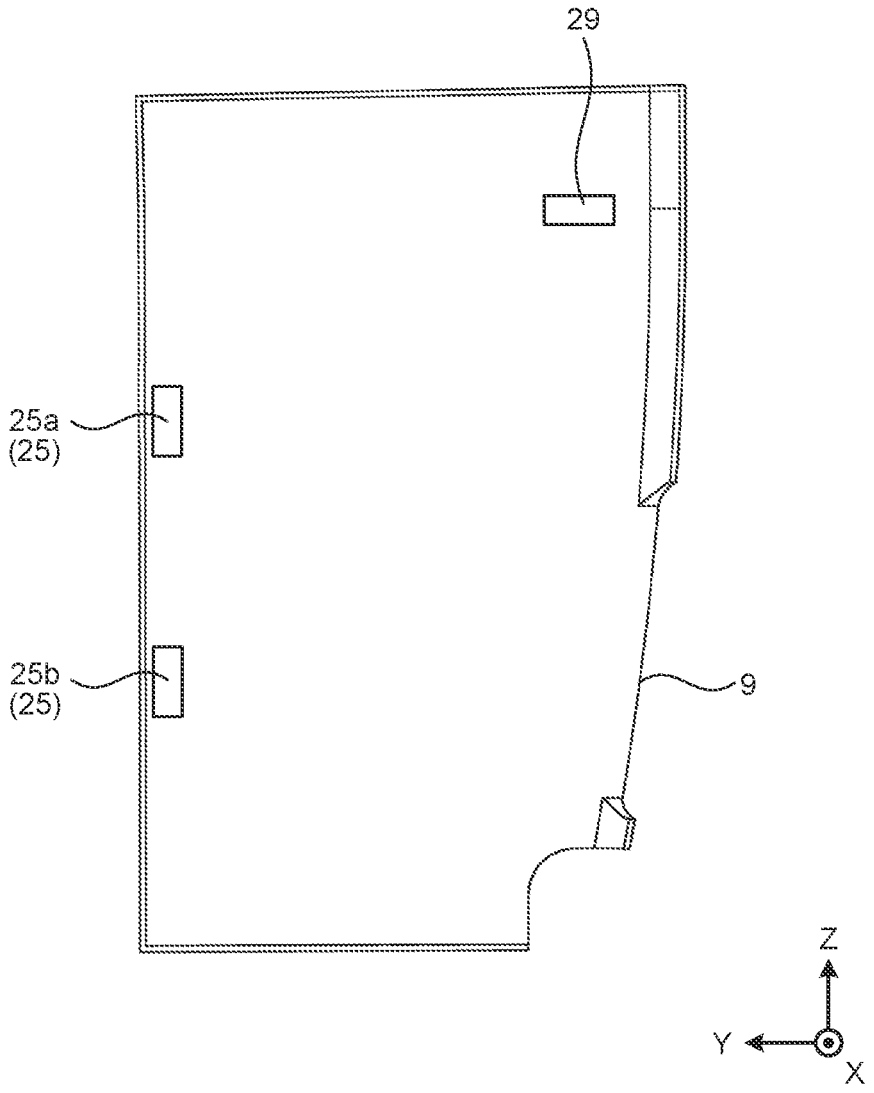
FIG. 3 is a side view illustrating the panel member according to the first embodiment viewed from the inside.

Herein, the first holding parts 21 will be explained additionally with reference to FIG. 3. FIG. 3 is a side view illustrating the panel member 9 according to the first embodiment viewed from the inside.

As illustrated in FIGS. 1 to 3, each of the first holding parts 21 includes a panel-side magnetic material 25 and a body-side magnetic material 27. The panel-side magnetic material 25 is a magnetic material provided in the panel member 9, and is a magnet, for example. Hereinafter, the panel-side magnetic material 25 may be referred to as "magnet 25". The body-side magnetic material 27 is a magnetic material provided in the toilet body 3, and is a metallic sheet material, in other words, a sheet metal, for example. Hereinafter, the body-side magnetic material 27 may be referred to as "sheet metal 27".

In the above mentioned, an example is indicated in which the panel-side magnetic material 25 is a magnet, and the body-side magnetic material 27 is a sheet metal; however, not limited thereto, for example, the panel-side magnetic material 25 may be a sheet metal, and the body-side magnetic material 27 may be a magnet. Moreover, a magnet may be employed instead of the sheet metal 27.

Hereinafter, the magnet 25 of the upper holding part 21*a* may be referred to as an "upper magnet 25*a*", and the magnet 25 of the lower holding part 21*b* may be referred to as a "lower magnet 25*b*". The sheet metal 27 of the upper holding part 21*a* may be referred to as an "upper sheet metal 27*a*", and the sheet metal 27 of the lower holding part 21*b* may be referred to as a "lower sheet metal 27*b*".

The upper magnet 25*a* and the lower magnet 25*b* are arranged in a front edge part on an inner surface of the panel member 9, in other words, a periphery of a boundary between the toilet body 3 and the panel member 9. The upper magnet 25*a* is arranged in an interval between an upper end and the center of the panel member 9, and the lower magnet 25*b* is arranged in an interval between a lower end and the center of the panel member 9, for example.

As illustrated in FIGS. 1 and 2, the sheet metals 27 are arranged in positions corresponding to the respective magnets 25 in the toilet body 3. In other words, the upper sheet metal 27*a* is arranged in a position corresponding to the upper magnet 25*a*, and the lower sheet metal 27*b* is arranged in a position corresponding to the lower magnet 25*b*. Note that detailed configurations of the above-mentioned magnet 25 and the above-mentioned sheet metal 27 will be mentioned later with reference to FIG. 4 and the following.

The above-mentioned magnets 25 attract the sheet metals 27 by using magnetic force so that the first holding parts 21 are capable of holding the panel member 9 to the toilet body 3.

Next, the second holding part 23 will be explained. As illustrated in FIG. 1, in a case where the panel member 9 is appropriately arranged in the toilet body 3, the second holding part 23 is arranged in an upper region of the panel member 9. As illustrated in FIGS. 1 and 2, the second holding part 23 includes a magnet 29 that is a magnetic material, and a metallic sheet material that is a magnetic material, in other words a sheet metal 31.

The magnet 29 is arranged in an upper edge part of an inner surface of the panel member 9 and a rear part of the panel member 9. The magnet 29 is formed in a rectangular parallelepiped whose thickness is small, and is bonded to the panel member 9, for example. The magnet 29 is formed such that short sides thereof are along the up-and-down direction and long sides thereof are along the front-back direction; however, a shape of the magnet 29 is not limited thereto, and may be formed in an arbitrary shape.

As illustrated in FIGS. 1 and 2, the sheet metal 31 is arranged in a position in the toilet body 3 (precisely, function unit 5 arranged in rear part of toilet body 3) corresponding to the magnet 29. The sheet metal 31 is formed in a rectangular parallelepiped whose thickness is small, and is bonded to the function unit 5, for example. Note that the sheet metal 31 is formed such that short sides thereof are along the front-back direction and long sides thereof are along the up-and-down direction; however, a shape of the sheet metal 31 is not limited thereto, and may be formed in an arbitrary shape.

The above-mentioned magnet 29 attracts the sheet metal 31 by using magnetic force so that the second holding part 23 is capable of holding the panel member 9 to the toilet body 3.

Regarding the above-mentioned second holding part 23, the example is exemplified in which the magnet 29 is provided to the panel member 9 and the sheet metal 31 is provided to the toilet body 3; however, not limited thereto, a configuration may be employed in which the sheet metal is provided to the panel member 9 and the magnet is provided to the toilet body 3, for example. Moreover, a magnet may be employed instead of the sheet metal 31.

Positions where the above-mentioned first and second holding parts 21 and 23 are arranged and the number thereof are merely examples; however, not limited thereto, positions and/or the number of the first and second holding parts 21 and 23 may be arbitrarily set. In other words, in the above-mentioned, an example is indicated in which the number of the first holding parts 21 is plural (two); however, the number may be one, or equal to or more than three. Additionally, an example is indicated in which the number of the second holding parts 23 is one; however, the number may be equal to or more than two.

Attachment of the panel member 9 to the toilet body 3 in the flush toilet 1 configured as described above will be explained, and the panel member 9 is positioned on a side (precisely, side of function unit 5) of the toilet body 3, for example. Subsequently, the above-mentioned panel member 9 is moved toward the toilet body 3 along the left-right direction (X-axis direction), and thus the panel member 9 is attached to the toilet body 3 by magnetic force of the first and second holding parts 21 and 23.

Incidentally, in the flush toilet 1, a side surface of the panel member 9 is formed in curve-shaped in some cases, in order to improve design and usability, for example. As described above, in a case where the panel member 9 is formed in curve-shaped, in a conventional technology, an attraction surface of a magnetic material, such as the magnet 25 provided to the panel member 9, is accordingly curved, and thus the attraction surface is not appropriately in contact with an attraction surface of a magnetic material, such as the sheet metal 27 provided to the toilet body 3, so as to decrease holding force with respect to the panel member 9. Therefore, for example, in a case where the panel member 9 is wiped down for cleaning, a load (force) works on the panel member 9, which moves the panel member 9, and the load exceeds the decreased holding force; the panel member 9 easily falls off from the toilet body 3.

For example, in a case where an attraction surface of a magnetic material such as the magnet 25 is formed in curve-shaped, the panel member 9 is hard to slide in a state where the panel member 9 is held to the toilet body 3, so that positioning of the panel member 9 becomes difficult.

Thus, the flush toilet 1 according to the present embodiment is configured to allow sliding of the panel member 9 and to facilitate positioning while preventing falling off of the panel member 9 that is attached to the toilet body 3.

Figure 4:
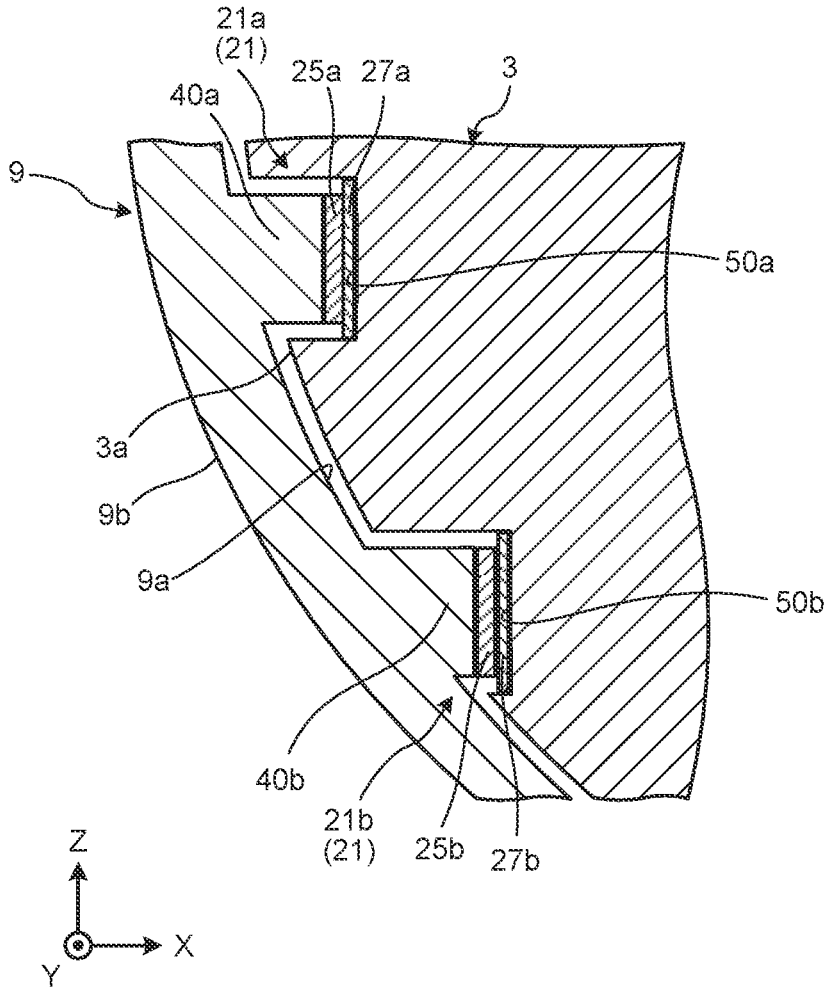
FIG. 4 is a cross-sectional view taken along a line IV-IV illustrated in FIG. 1.
Figure 5:
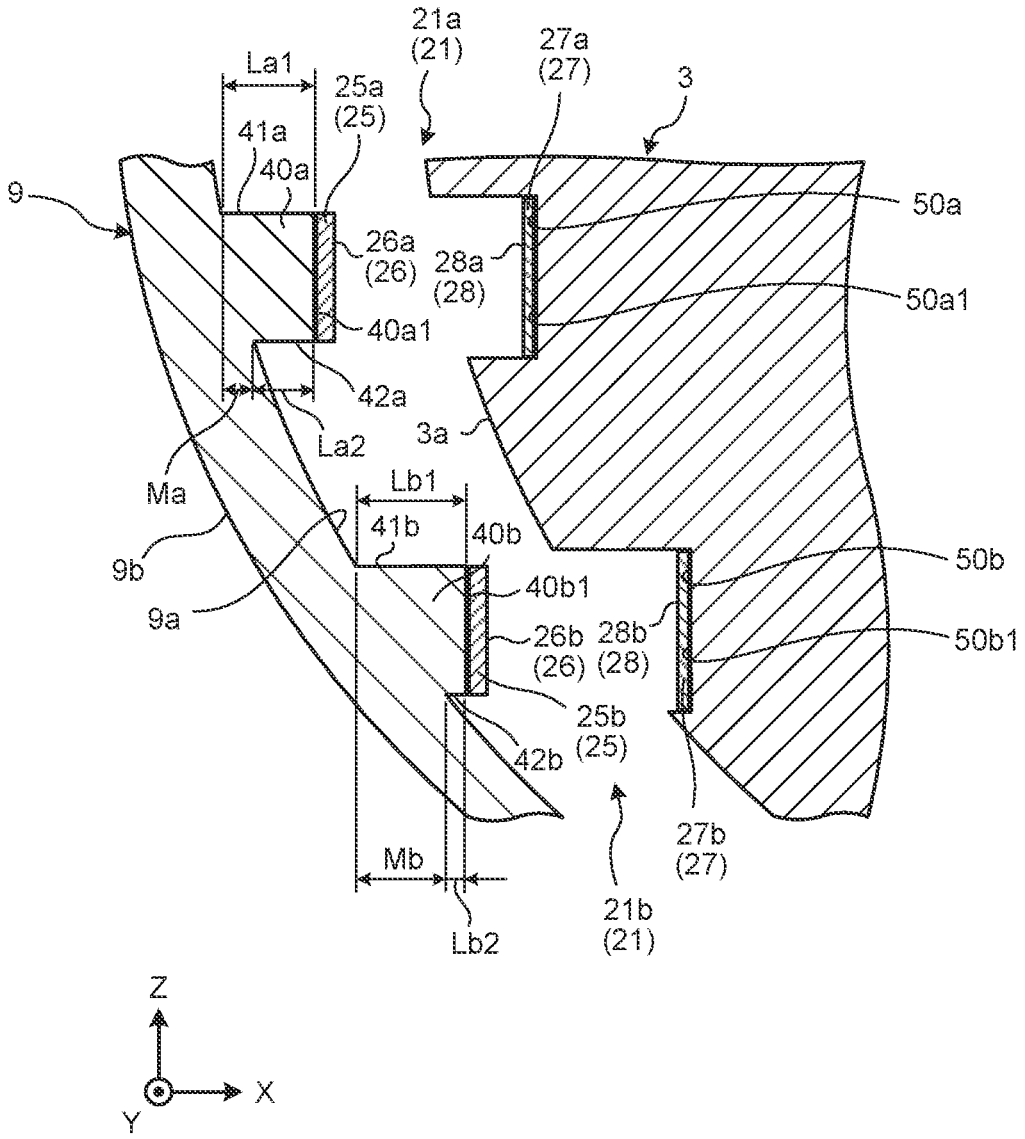
FIG. 5 is an enlarged cross-sectional view illustrating a periphery of first holding parts.

Hereinafter, details of the above-mentioned configuration will be explained with reference to FIGS. 4 and 5. FIG. 4 is a cross-sectional view taken along a line IV-IV illustrated in FIG. 1, and specifically, a cross-sectional view illustrating a periphery of the first holding parts 21. Note that in FIG. 4 and the following, for convenience of explanation, a part of the configuration, such as a curved shape of the panel member 9, is indicated in an emphasized manner. FIG. 5 is an enlarged cross-sectional view illustrating a periphery of the first holding parts 21, which is similar to FIG. 4. Note that FIG. 5 illustrates a state before the panel member 9 is attached to the toilet body 3 by the first holding parts 21 or the like.

As illustrated in FIGS. 4 and 5, the panel member 9 according to the present embodiment is formed in curve-shaped in a front view (or rear view viewed from the rear) viewed from the front. For example, the panel member 9 is formed in curve-shaped along the toilet body 3 in a state where the panel member 9 is attached to the toilet body 3. In other words, the panel member 9 is formed in curve-shaped such that an inner surface 9*a* and an outer surface 9*b* protrude toward the outside (in examples illustrated in FIGS. 4 and 5, X-axis negative direction).

The panel member 9 is formed such that a curvature thereof is larger as a position is lower (Z-axis negative direction). In other words, in the panel member 9, a curvature of a part in which the lower holding part 21*b* is arranged is set to be larger than a curvature of a part in which the upper holding part 21*a* is arranged.

The toilet body 3 is formed in a shape according to the panel member 9. For example, an outer surface 3*a* is formed on the toilet body 3, to which the panel member 9 is attached, such that the outer surface 3*a* is curved along the inner surface 9*a* of the panel member 9.

Next, the upper holding part 21*a* and the lower holding part 21*b* included in the first holding parts 21 will be explained. The upper holding part 21*a* includes the above-mentioned upper magnet 25*a*, the upper sheet metal 27*a*, an upper-side protruding part 40*a*, and an upper concave part 50*a*. The lower holding part 21*b* includes the above-mentioned lower magnet 25*b*, the lower sheet metal 27*b*, a lower protruding part 40*b*, and a lower concave part 50*b*.

Each of the upper magnet 25*a* and the lower magnet 25*b* is a rectangular parallelepiped whose thickness is small. As illustrated in FIGS. 1 and 3, each of the upper magnet 25*a* and the lower magnet 25*b* is formed in a shape whose short sides are along the front-back direction and whose long sides are along the up-and-down direction; however, shapes of the upper magnet 25*a* and the lower magnet 25*b* are not limited thereto, and may be set to arbitrary shapes. Note that in the above-mentioned, an example is indicated in which the upper magnet 25*a* and the lower magnet 25*b* have the same shape; however, not limited thereto, may have different shapes.

Each of the upper sheet metal 27*a* and the lower sheet metal 27*b* is a rectangular parallelepiped whose thickness is small. As illustrated in FIGS. 1 and 2 and the like, each of the upper sheet metal 27*a* and the lower sheet metal 27*b* is formed in a shape whose short sides are along the front-back direction and whose long sides are along the up-and-down direction; however, shapes of the upper sheet metal 27*a* and the lower sheet metal 27*b* are not limited thereto, and may be set to arbitrary shapes. Note that in the above-mentioned, an example is indicated in which the upper sheet metal 27*a* and the lower sheet metal 27*b* have the same shape; however, not limited thereto, may have different shapes.

Each of the upper-side protruding part 40*a* and the lower protruding part 40*b* is formed so as to protrude from the panel member 9 toward the toilet body 3. For example, each of the upper-side protruding part 40*a* and the lower protruding part 40*b* is formed so as to protrude from the inner surface 9*a* of the panel member 9 toward the toilet body 3 (X-axis positive direction in example illustrated in FIGS. 4 and 5).

As illustrated in FIG. 5, a leading-end surface 40*a*1 of the upper-side protruding part 40*a* is formed in plane-shaped (in other words, flat-shaped), the upper magnet 25*a* is attached to (bonded to) the above-mentioned leading-end surface 40*a*1. A leading-end surface 40*b*1 of the lower protruding part 40*b* is formed in plane-shaped, the upper magnet 25*a* is attached to (bonded to) the above-mentioned leading-end surface 40*a*1.

Each of the upper concave part 50*a* and the lower concave part 50*b* is a dent that is formed in the toilet body 3. For example, the upper concave part 50*a* is formed in a position corresponding to the upper-side protruding part 40*a* and the upper magnet 25*a*, to be concavely formed from the outer surface 3*a* of the toilet body 3 in the X-axis positive direction. The lower concave part 50*b* is formed in a position corresponding to the lower protruding part 40*b* and the lower magnet 25*b*, to be concavely formed from the outer surface 3*a* of the toilet body 3 in the X-axis positive direction.

As illustrated in FIG. 5, a surface 50*a*1 of the upper concave part 50*a*, which is opposite to the leading-end surface 40*a*1 of the upper-side protruding part 40*a*, is formed in plane-shaped (in other words, flat-shaped), the upper sheet metal 27*a* is attached to (bonded to) the above-mentioned surface 50*a*1. A surface 50*b*1 of the lower concave part 50*b*, which is opposite to the leading-end surface 40*b*1 of the lower protruding part 40*b*, is formed in plane-shaped, the lower sheet metal 27*b* is attached to (bonded to) the above-mentioned surface 50*b*1.

The first holding parts 21 are formed such that an attraction surface 26 of the magnet 25 and an attraction surface 28 of the sheet metal 27 are plane-shaped (in other words, flat-shaped).

Thus, in the present embodiment, it is possible to allow the panel member 9 to slide so as to facilitate positioning thereof while preventing falling off the panel member 9 attached to the toilet body 3.

In other words, in the first holding parts 21, the attraction surface 26 of the magnet 25 and the attraction surface 28 of the sheet metal 27 are configured as described above, the attraction surface 26 of the magnet 25 and the attraction surface 28 of the sheet metal 27 are in contact by surfaces with each other, so that it is possible to reliably ensure a contact area. Thus, in the first holding parts 21, holding force with respect to the panel member 9 hardly decreases even in a case where the panel member 9 is formed in curve-shaped. Thus, in the present embodiment, it is possible to prevent falling off of the panel member 9 even in a case where the panel member 9 is wiped down for cleaning and load works on the panel member 9, which moves the panel member 9, for example.

In the first holding parts 21, the attraction surface 26 of the magnet 25 and the attraction surface 28 of the sheet metal 27 are in contact by surfaces with each other, so that it is possible to easily slide the panel member 9 in a direction (herein, front-back direction or up-and-down direction) that is parallel to the attraction surfaces 26 and 28. Thus, for example, a contractor is able to slide the panel member 9 with respect to the toilet body 3 or the like in the front-back direction (see arrow D1 illustrated in FIG. 1) or the up-and-down direction (see arrow D2) in a state where the panel member 9 is held by the toilet body 3 or the like, so that it is possible to easily adjust the panel member 9 to an appropriate position, in other words, it is possible to facilitate positioning of the panel member 9.

The first holding parts 21 will be more specifically explained, and in each of the upper holding part 21*a* and the lower holding part 21*b* included in the first holding parts 21, the attraction surface 26 of the magnet 25 and the attraction surface 28 of the sheet metal 27 are formed in plane-shaped. Specifically, in the upper holding part 21*a*, an attraction surface 26*a* of the upper magnet 25*a* and an attraction surface 28*a* of the upper sheet metal 27*a* are formed in plane-shaped. Similarly, in the lower holding part 21*b*, an attraction surface 26*b* of the lower magnet 25*b* and an attraction surface 28*b* of the lower sheet metal 27*b* are formed in plane-shaped.

As described above, in a case where there presents the plurality of first holding parts 21 (specifically, even in a case where upper holding part 21*a* and lower holding part 21*b* are included), the attraction surface 26 of the corresponding magnet 25 and the attraction surface 28 of the corresponding sheet metal 27 are in contact by surfaces with each other, so that it is possible to further reliably prevent falling off the panel member 9, and further to allow sliding of the panel member 9 and to facilitate positioning thereof.

Each of the first holding parts 21 is formed such that the attraction surface 26 of the magnet 25 and the attraction surface 28 of the sheet metal 27 are parallel to each other. In other words, in a state where the panel member 9 is attached to the toilet body 3, each of the first holding parts 21 is formed such that the attraction surface 26 of the magnet 25 and the attraction surface 28 of the sheet metal 27, which is opposite to the attraction surface 26, are parallel to each other.

Specifically, in the upper holding part 21*a*, the attraction surface 26*a* of the upper magnet 25*a* and the attraction surface 28*a* of the upper sheet metal 27*a* are formed to be parallel to each other. Similarly, in the lower holding part 21*b*, the attraction surface 26*b* of the lower magnet 25*b* and the attraction surface 28*b* of the lower sheet metal 27*b* are formed to be parallel to each other.

Thus, for example, even in a case where the panel member 9 is formed in curve-shaped, if the attraction surface 26 of the magnet 25 and the attraction surface 28 of the sheet metal 27 are formed to be parallel to each other, the attraction surface 26 of the magnet 25 and the attraction surface 28 of the sheet metal 27 are reliably in contact by surfaces with each other, so that it is possible to further reliably prevent falling off of the panel member 9, and further to allow sliding of the panel member 9 and to facilitate positioning thereof.

In the first holding parts 21, the attraction surfaces 26 of the magnets 25 and the attraction surfaces 28 of the sheet metals 27 are formed to be along a perpendicular surface (Y-Z plane) in the front-back direction. In other words, each pair of the attraction surface 26 of the magnet 25 and the attraction surface 28 of the sheet metal 27 are formed to be perpendicular to the floor surface 100 (see FIG. 1) on which the flush toilet 1 is arranged.

Specifically, in the upper holding part 21*a*, the attraction surface 26*a* of the upper magnet 25*a* and the attraction surface 28*a* of the upper sheet metal 27*a* are formed to be along a perpendicular surface (Y-Z plane) in the front-back direction. Similarly, in the lower holding part 21*b*, the attraction surface 26*b* of the lower magnet 25*b* and the attraction surface 28*b* of the lower sheet metal 27*b* are formed to be along a perpendicular surface (Y-Z plane) in the front-back direction.

Thus, in the first holding parts 21, the attraction surface 26 of the magnet 25 and the attraction surface 28 of the sheet metal 27 are in contact by surfaces with each other along the perpendicular direction, so that it is possible to further easily slide the panel member 9 in a direction (herein, front-back direction or up-and-down direction) parallel to the attraction surfaces 26 and 28. Thus, for example, a contractor is able to slide the panel member 9 in the front-back direction or the up-and-down direction in a state where the panel member 9 is held by the toilet body 3 or the like, so that it is possible to further easily adjust the panel member 9 to an appropriate position.

The first holding parts 21 includes the above-mentioned upper-side protruding part 40*a* and the above-mentioned lower protruding part 40*b*, for example, and thus even in a case where the panel member 9 is formed in curve-shaped, it is possible to attach the magnets 25 such that the attraction surfaces 26 become plane-shaped by employing a simple configuration in which the leading-end surface 40*a*1 of the upper-side protruding part 40*a* and the leading-end surface 40*b*1 of the lower protruding part 40*b* are formed in plane-shaped, for example.

Herein, shapes of the upper-side protruding part 40*a* and the lower protruding part 40*b* will be explained. Shapes of the upper-side protruding part 40*a* and the lower protruding part 40*b* are set in accordance with a curved shape of the panel member 9 on which the upper-side protruding part 40*a* and the lower protruding part 40*b* are formed.

Specifically, as illustrated in FIG. 5, in the first holding parts 21, a difference Mb between a length Lb1 in a width direction (left-right direction) of an upper surface 41*b* in the lower protruding part 40*b* of the lower holding part 21*b* and a length Lb2 of a lower surface 42*b* in the width direction is set to be larger than a difference Ma between a length La1 in a width direction of an upper surface 41*a* in the upper-side protruding part 40*a* of the upper holding part 21*a* and a length La2 in the width direction of the lower surface 42*a* (Mb>Ma).

As described above, the lower protruding part 40*b* and the upper-side protruding part 40*a* are configured as described above, for example, and thus the panel member 9 can be attached to the toilet body 3 with high accuracy even in a shape where a curvature of a lower part of the panel member 9 is larger than that of an upper part thereof.

If the difference indicated by Mb-Ma is set to be comparatively large, it is possible to further improve workability of the panel member 9. In other words, if the difference indicated by Mb-Ma is set to be large, for example, in a case where the panel member 9 is attached to the toilet body 3 along the width direction, or in a case where the panel member 9 is slid from below to be attached to the toilet body 3, in the lower holding part 21*b*, the panel member 9 is completely attached to the toilet body 3 compared with the upper holding part 21*a*, a margin is generated in the up-and-down direction until movement is limited. Thus, for example, it is sufficient that a contractor attach the panel member 9 while taking care of the upper holding part 21*a* alone, so that it is possible to further improve workability of the panel member 9.

For the above-mentioned sheet metal 27 (upper sheet metal 27*a* or lower sheet metal 27*b*), for example, a sheet metal whose surface is cut at random. Thus, a surface roughness of the sheet metal 27 increases so as to increase a frictional force thereof, so that it is possible to effectively prevent falling off of the panel member 9.

Note that in the above-mentioned, magnets having the same size and the same magnetic force are employed for the upper magnet 25*a* and the lower magnet 25*b*; however, not limited thereto. In other words, sizes and/or magnetic forces of the upper magnet 25*a* and the lower magnet 25*b* may be different from each other. For one example, a magnet may be employed for the lower magnet 25*b*, whose size and/or magnetic force is larger than the upper magnet 25*a*. Thus, for example, magnetic force of the lower holding part 21*b* arranged in a lower part of the panel member 9, which has a comparatively large curvature and thus is easily detached from the toilet body 3, can be increased, so that it is possible to further effectively prevent falling off of the panel member 9.

As described above, the flush toilet 1 according to the first embodiment includes the toilet body 3, the function unit 5, the panel member 9, and the first holding part 21 (one example of holding part). The function unit 5 is arranged in a rear part of the toilet body 3. The panel member 9 covers a side surface of the function unit 5. The first holding part 21 causes the toilet body 3 and a side surface of the panel member 9 to attract and hold to each other by using magnetic force. In a state where being attached to the toilet body 3, the panel member 9 is formed to be curved toward the toilet body 3. The first holding part 21 is formed such that the attraction surface 26 of the panel-side magnetic material 25 that is provided to the panel member 9 and the attraction surface 28 of the body-side magnetic material 27 that is provided to the toilet body 3 are formed in plane-shaped. Thus, it is possible to allow sliding of the panel member 9 so as to facilitate positioning thereof while preventing falling off of the panel member 9 that is attached to the toilet body 3.

Modification

Next, a modification will be explained with reference to FIG. 6. In the following explanation, parts similar to those having been already explained are provided with the same reference symbols as those of the already-explained parts, and duplicated explanation is appropriately omitted.

Figure 6:
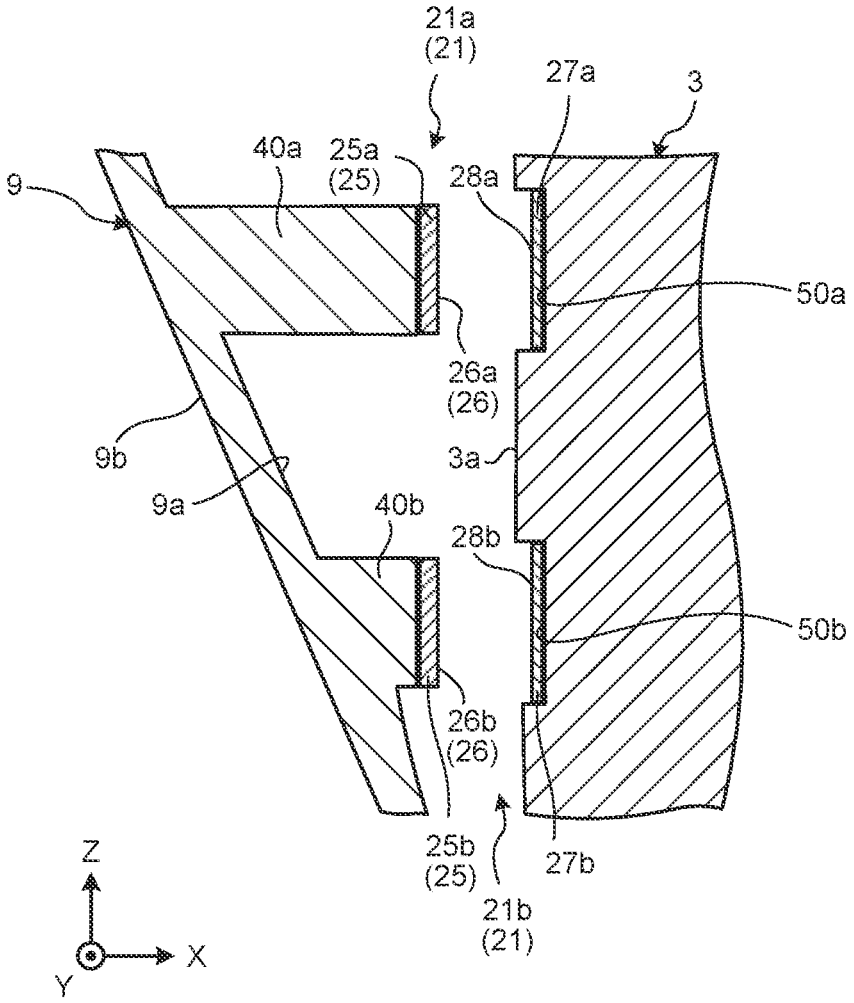
FIG. 6 is a diagram illustrating the first holding part according to a modification.

FIG. 6 is a diagram illustrating the first holding parts 21 according to the modification. FIG. 6 is an enlarged cross-sectional view illustrating a periphery of the first holding parts 21, which is similar to FIG. 5.

As illustrated in FIG. 6, a side surface of the panel member 9 according to the modification is linearly formed. In other words, the inner surface 9*a* and the outer surface 9*b* of the panel member 9 are linearly formed. The outer surface 3*a* of the toilet body 3 to which the panel member 9 is attached is linearly formed.

Herein, the panel member 9 is attached to the toilet body 3 such that side surfaces thereof (inner surface 9*a* and outer surface 9*b*) are not parallel to the outer surface 3*a* of the toilet body 3. In the example illustrated in FIG. 6, a side surface of the panel member 9 slopes with respect to a perpendicular surface in the front-back direction, and the outer surface 3*a* of the toilet body 3 is formed to be along a perpendicular surface in the front-back direction.

Even in a case where the panel member 9 and the toilet body 3 have the above-mentioned shapes, the first holding parts 21 are formed such that the attraction surfaces 26 of the magnets 25 and the attraction surfaces 28 of the sheet metals 27 are plane-shaped (in other words, flat-shaped).

Thus, in the modification, similar to the embodiment, it is possible to prevent falling off of the panel member 9 attached to the toilet body 3, and further to allow sliding of the panel member 9 and to facilitate positioning thereof.

Second Embodiment

Next, a second embodiment will be explained. In the second embodiment, configurations of the second holding part 23 and the function unit 5 are employed which allow the panel member 9 to slide to facilitate positioning thereof while preventing falling off the panel member 9.

Figure 7:
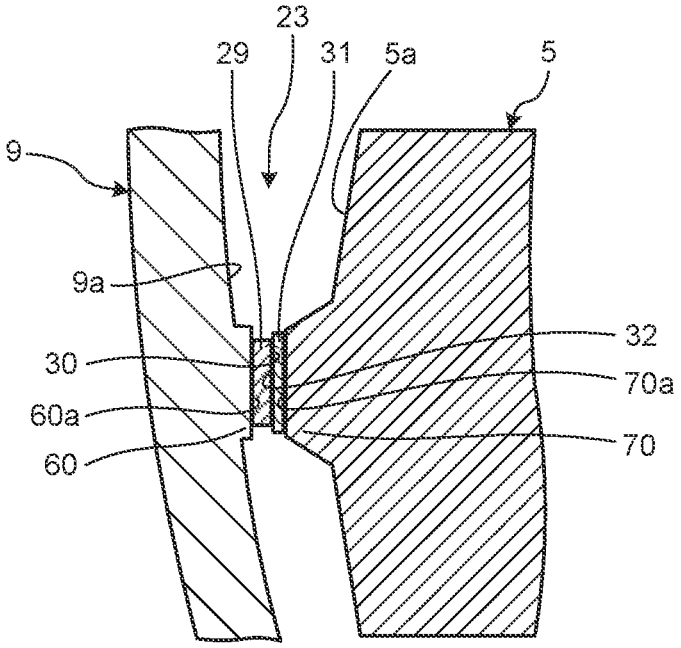
FIG. 7 is a cross-sectional view taken along a line VII-VII illustrated in FIG. 1.
Figure 7:
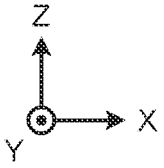

Hereinafter, the above-mentioned configurations will be specifically explained with reference to FIG. 7 and the like. FIG. 7 is a cross-sectional view taken along a line VII-VII illustrated in FIG. 1, and specifically, is an enlarged cross-sectional view illustrating a periphery of the second holding part 23. Note that in FIG. 7 and the like, for simplifying the illustration, the function unit 5 is provided with diagonal lines to be schematically illustrated.

The second holding part 23 includes the above-mentioned magnet 29, the above-mentioned sheet metal 31, a panel-side protruding part 60, and a function-unit-side protruding part 70. Note that the magnet 29 is one example of a panel-side magnetic material, and the sheet metal 31 is one example of a function-unit-side magnetic material.

As described above, the magnet 29 is a rectangular parallelepiped whose thickness is small, for example, is bonded to the panel member 9 (precisely, panel-side protruding part 60 of panel member 9). As described above, the sheet metal 31 is a rectangular parallelepiped whose thickness is small, and is bonded to, for example, the function unit 5 (precisely, function-unit-side protruding part 70).

The panel-side protruding part 60 is formed so as to protrude from the panel member 9 toward the function unit 5. For example, the panel-side protruding part 60 is formed so as to protrude from the inner surface 9*a* of the panel member 9 toward the function unit 5 (X-axis positive direction in example illustrated in FIG. 7). A leading-end surface 60*a* of the panel-side protruding part 60 is formed in plane-shaped (in other words, flat-shaped), and the magnet 29 is attached to (bonded to) the above-mentioned leading-end surface 60*a*.

The function-unit-side protruding part 70 is formed so as to protrude from the function unit 5 toward the panel member 9. For example, the function-unit-side protruding part 70 is formed so as to protrude from a side surface 5*a* of the function unit 5 toward the panel member 9 (X-axis negative direction in example illustrated in FIG. 7). A leading-end surface 70*a* of the function-unit-side protruding part 70 is formed in plane-shaped (in other words, flat-shaped), the sheet metal 31 is attached to (bonded to) the above-mentioned leading-end surface 70*a*.

As described above, in the second embodiment, a surface of the function unit 5 on which the sheet metal 31 is arranged, in other words, the leading-end surface 70*a* of the function-unit-side protruding part 70 is formed in plane-shaped, and further is formed to be along a perpendicular surface (Y-Z plane) in the front-back direction. In other words, in the function unit 5, a surface (leading-end surface 70*a*) to which the sheet metal 31 is attached is formed to be perpendicular to the floor surface 100 (see FIG. 1) on which the flush toilet 1 is arranged.

Figure 8:
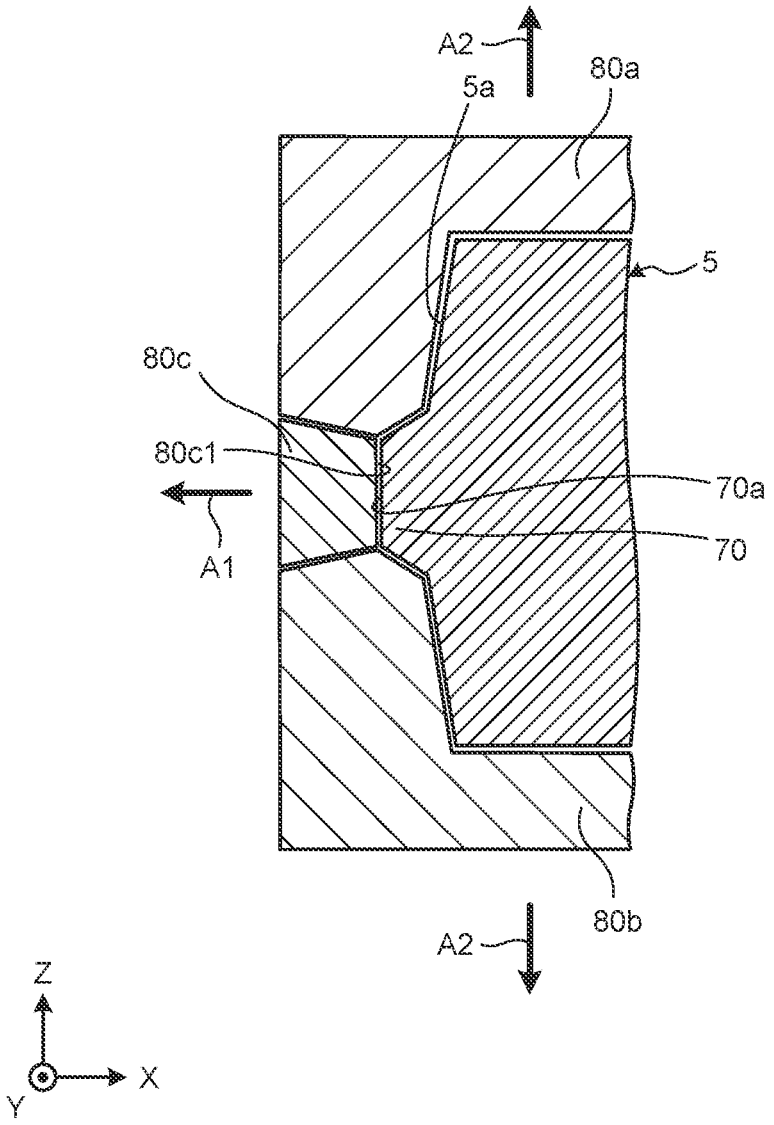
FIG. 8 is a diagram illustrating formation of a function unit according to a second embodiment.
Figure 9:
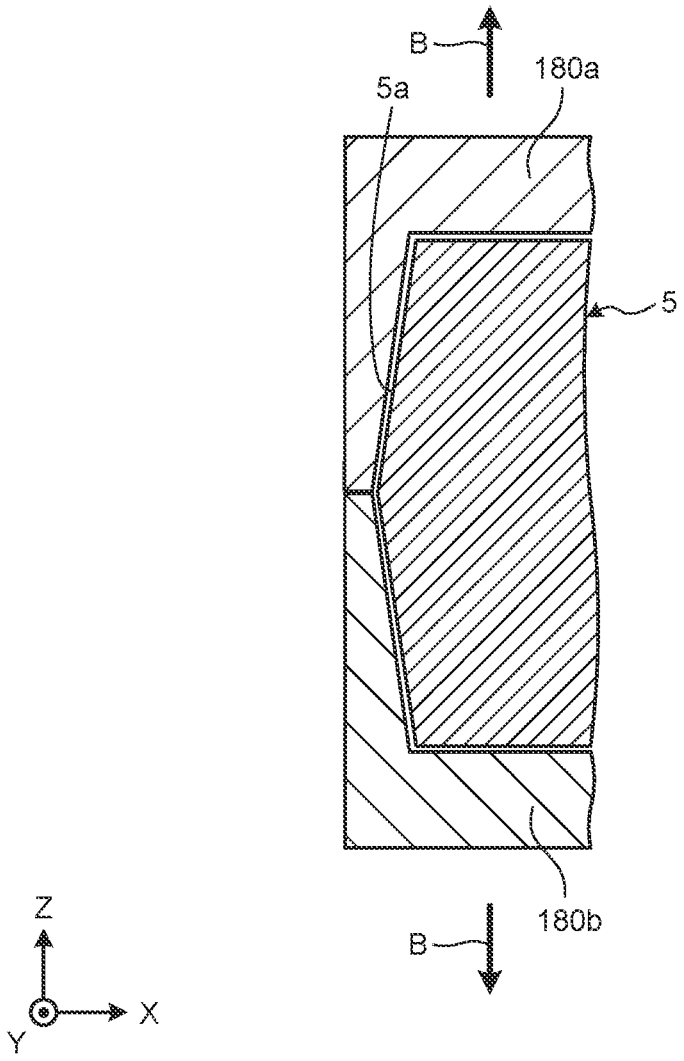
FIG. 9 is a diagram illustrating formation of a function unit according to a comparison example.

Herein, formation of a surface of the function unit 5 on which the sheet metal 31 is arranged, in other words, the leading-end surface 70*a* of the function-unit-side protruding part 70 will be explained with reference to FIGS. 8 and 9. FIG. 8 is a diagram illustrating formation of the function unit 5 according to the second embodiment, and FIG. 9 is a diagram illustrating formation of the function unit 5 according to a comparison example. A part of or whole of the function unit 5 is formed by using a mold. Specifically, a molten resin material flows into a mold so as to form the function unit 5.

The comparison example illustrated in FIG. 9 will be explained. As illustrated in FIG. 9, in the comparison example, the function unit 5 is formed by using an upper mold 180*a* and a lower mold 180*b*. Specifically, the upper mold 180*a* and the lower mold 180*b* are attached to each other, a molten resin material flows into a space that is formed by the upper and the lower molds 180*a* and 180*b*, so that the function unit 5 is formed. Next, the upper and the lower molds 180*a* and 180*b* are pulled out along the up-and-down directions (Z-axis direction, see arrows B) from the formed function unit 5. However, if the comparison example is configured as described above, the side surface 5*a* of the formed function unit 5 may be sloped with respect to the up-and-down direction (Z-axis direction) due to pulling gradients of the upper and the lower molds 180*a* and 180*b*. Thus, in the side surface 5*a* of the function unit 5 according to the comparison example, a surface on which the sheet metal 31 is to be arranged is not formed to be along a perpendicular surface (Y-Z plane), and as a result, there presents possibility that the sheet metal 31 is not arranged to be along the perpendicular surface.

In the second embodiment, as illustrated in FIG. 8, a mold is employed in which a surface of the function unit 5 on which the sheet metal 31 is to be arranged, in other words, the leading-end surface 70*a* of the function-unit-side protruding part 70 is formed to be along a perpendicular surface (Y-Z plane).

Specifically, in the second embodiment, the function unit 5 is formed by using an upper mold 80*a*, a lower mold 80*b*, and a side-surface-side mold 80*c*. The upper mold 80*a* is arranged on an upper side with respect to the function unit 5 to be formed, the lower mold 80*b* is arranged on a lower side with respect to the function unit 5 to be formed, and the side-surface-side mold 80*c* is arranged on a side of the side surface 5*a* with respect to the function unit 5 to be formed, and then are assembled. In the upper mold 80*a*, the lower mold 80*b*, and the side-surface-side mold 80*c* having been assembled, a concave part 80*c*1 is formed which is corresponding to a shape of the function-unit-side protruding part 70. In other words, the concave part 80*c*1 is formed such that the leading-end surface 70*a* of the formed function-unit-side protruding part 70 is along the perpendicular surface.

As one example of a formation procedure, the upper, the lower, and the side-surface-side molds 80*a*, 80*b*, and 80*c* are assembled, and a molten resin material flows into a space formed by the upper, the lower, and the side-surface-side molds 80*a*, 80*b*, and 80*c*, so that the function unit 5 is formed. Next, the side-surface-side mold 80*c* is pulled out from the formed function unit 5 in the left-right direction (X-axis direction, see arrow A1). Next, the upper and the lower molds 80*a* and 80*b* are pulled out from the formed function unit 5 in the up-and-down direction (Z-axis direction, see arrows A2). Thus, in the side surface 5*a* of the function unit 5, a surface (leading-end surface 70*a* of function-unit-side protruding part 70) on which the sheet metal 31 is arranged is formed to be along the perpendicular surface (Y-Z plane) while ensuring pulling gradients of the molds 80*a*, 80*b*, and 80*c*.

Returning to FIG. 7, in the function unit 5 that is formed as described above, the sheet metal 31 is attached to the leading-end surface 70*a* of the function-unit-side protruding part 70. Next, in the second holding part 23, an attraction surface 30 of the magnet 29 and an attraction surface 32 of the sheet metal 31 are formed in plane-shaped (in other words, flat-shaped).

Thus, it is possible to allow sliding of the panel member 9 so as to facilitate positioning thereof while preventing falling off of the panel member 9 that is attached to the function unit 5.

In other words, in the second holding part 23, the attraction surface 30 of the magnet 29 and the attraction surface 32 of the sheet metal 31 are configured as described above, and thus the attraction surface 30 of the magnet 29 and the attraction surface 32 of the sheet metal 31 are in contact by surfaces with each other, so that it is possible to reliably ensure a contact area therebetween. Thus, even in a case where the panel member 9 is formed in curve-shaped, in the second holding part 23, a holding force applied to the panel member 9 hardly decreases. Thus, in the second embodiment, for example, it is possible to prevent falling off of the panel member 9 even in a case where the panel member 9 is wiped down for cleaning and load works on the panel member 9, which moves the panel member 9.

In the second holding part 23, the attraction surface 30 of the magnet 29 and the attraction surface 32 of the sheet metal 31 are in contact by surfaces with each other, so that it is possible to easily slide the panel member 9 in a direction (herein, front-back direction and/or up-and-down direction) that is parallel to the attraction surfaces 30 and 32. Thus, for example, a contractor is able to slide the panel member 9 with respect to the function unit 5 or the like in the front-back direction (see arrow D1 illustrated in FIG. 1) or the up-and-down direction (see arrow D2) in a state where the panel member 9 is held by the function unit 5 or the like, so that it is possible to easily adjust the panel member 9 to an appropriate position, in other words, it is possible to facilitate positioning of the panel member 9.

In the function unit 5, a surface (leading-end surface 70*a*) on which the sheet metal 31 is arranged is formed to be along a perpendicular surface in the front-back direction, the sheet metal 31 is attached to the function unit 5 so as to be along the perpendicular surface. Thus, in the second holding part 23, the attraction surface 30 of the magnet 29 and the attraction surface 32 of the sheet metal 31 are in contact by surfaces with each other along the perpendicular direction, so that it is possible to more easily slide the panel member 9 in a direction (herein, front-back direction or up-and-down direction) that is parallel to the attraction surfaces 30 and 32. Thus, for example, a contractor is able to slide the panel member 9 in the front-back direction or the up-and-down direction in a state where the panel member 9 is held by the function unit 5 or the like, so that it is possible to more easily adjust the panel member 9 to an appropriate position.

Any of the above-mentioned first, the second embodiment, and the modification may be appropriately combined with each other.

A flush toilet according to one aspect of embodiments includes: a toilet body; a function unit that is arranged in a rear part of the toilet body; a panel member that covers a side surface of the function unit; and a holding part that causes the toilet body and a side surface of the panel member to attract and hold to each other by using magnetic force, wherein in a state where being attached to the toilet body, the panel member is formed to be curved toward the toilet body, and the holding part is formed such that an attraction surface of a panel-side magnetic material that is provided to the panel member and an attraction surface of a body-side magnetic material that is provided to the toilet body are formed in plane-shaped.

Thus, it is possible to allow sliding of a panel member so as to facilitate positioning thereof while preventing falling off of the panel member that is attached to a toilet body.

In other words, in the holding part, the attraction surface of the panel-side magnetic material (for example, magnet) and the attraction surface of the body-side magnetic material (for example, sheet metal) are configured as described above, the attraction surface of the panel-side magnetic material and the attraction surface of the body-side magnetic material are in contact by surfaces with each other, so that it is possible to reliably ensure a contact area. Thus, in the holding part, holding force with respect to the panel member hardly decreases even in a case where the panel member is formed in curve-shaped. Thus, it is possible to prevent falling off of the panel member even in a case where the panel member is wiped down for cleaning and load works on the panel member, which moves the panel member, for example.

In the holding part, the attraction surface of the panel-side magnetic material and the attraction surface of the body-side magnetic material are in contact by surfaces with each other, so that it is possible to easily slide the panel member in a direction (for example, front-back direction or up-and-down direction) that is parallel to the attraction surfaces. Thus, for example, a contractor is able to slide the panel member with respect to the toilet body or the like in the front-back direction or the up-and-down direction in a state where the panel member is held by the toilet body or the like, so that it is possible to easily adjust the panel member to an appropriate position, in other words, it is possible to facilitate positioning of the panel member.

The holding part includes a plurality of holding parts, and each of the plurality of holding parts includes the panel-side magnetic material and the body-side magnetic material, and an attraction surface of the panel-side magnetic material and an attraction surface of the body-side magnetic material are formed in plane-shaped.

Thus, in a case where there presents the plurality of first holding parts, the attraction surface of the panel-side magnetic material and the attraction surface of the body-side magnetic material are in contact by surfaces with each other, so that it is possible to further reliably prevent falling off the panel member, and further to allow sliding of the panel member and to facilitate positioning thereof.

The holding part includes a protruding part that is formed to protrude from the panel member toward the toilet body.

As described above, the holding part includes a protruding part, and thus even in a case where the panel member is formed in curve-shaped, it is possible to attach the panel-side magnetic material such that the attraction surface become plane-shaped by employing a simple configuration in which the leading-end surface of the protruding part is formed in plane-shaped, for example.

In a state where the panel member is attached to the toilet body, the holding part includes: an upper holding part; and a lower holding part that is arranged under the upper holding part, and a difference between a length in a width direction of an upper surface and a length in a width direction of a lower surface in the protruding part of the lower holding part is set to be larger than a difference between a length in a width direction of an upper surface and a length in a width direction of a lower surface in the protruding part of the upper holding part.

As described above, the protruding part is configured as described above, for example, and thus the panel member can be attached to the toilet body with high accuracy even in a shape where a curvature of a lower part of the panel member is larger than that of an upper part thereof.

The holding part is formed such that an attraction surface of the panel-side magnetic material and an attraction surface of the body-side magnetic material are parallel to each other.

Thus, for example, even in a case where the panel member is formed in curve-shaped, if the attraction surface of the panel-side magnetic material and the attraction surface of the body-side magnetic material are formed to be parallel to each other, the attraction surface of the panel-side magnetic material and the attraction surface of the body-side magnetic material are reliably in contact with each other, so that it is possible to further reliably prevent falling off of the panel member, and further to allow sliding of the panel member and to facilitate positioning thereof.

The holding part is formed such that an attraction surface of the panel-side magnetic material and an attraction surface of the body-side magnetic material are formed to be along a perpendicular surface in a front-back direction.

Thus, in the first holding part, the attraction surface of the panel-side magnetic material and the attraction surface of the body-side magnetic material are in contact with each other along the perpendicular direction, so that it is possible to further easily slide the panel member in a direction (for example, front-back direction or up-and-down direction) parallel to the attraction surfaces. Thus, for example, a contractor is able to slide the panel member in the front-back direction or the up-and-down direction in a state where the panel member is held by the toilet body or the like, so that it is possible to further easily adjust the panel member to an appropriate position.

The holding part includes: a first holding part that causes the side surface of the toilet body and a side surface of the panel member to attract and hold to each other by using magnetic force; and a second holding part that causes the side surface of the function unit and the side surface of the panel member to attract and hold to each other by using magnetic force, the second holding part is formed such that an attraction surface of a panel-side magnetic material that is provided to the panel member and an attraction surface of a function-unit-side magnetic material provided to the function unit are formed in plane-shaped, and the function unit is formed such that a surface on which the function-unit-side magnetic material is arranged is formed to be along a perpendicular surface in a front-back direction.

Thus, it is possible to allow the panel member to slide so as to facilitate positioning thereof while preventing falling off the panel member attached to the function unit.

In other words, in the second holding part, the attraction surface of the panel-side magnetic material (for example, magnet) and the attraction surface of the function-unit-side magnetic material (for example, sheet metal) are configured as described above, and thus the attraction surface of the panel-side magnetic material and the attraction surface of the function-unit-side magnetic material are in contact by surfaces with each other, so that it is possible to reliably ensure a contact area therebetween. Thus, even in a case where the panel member is formed in curve-shaped, in the second holding part, a holding force applied to the panel member hardly decreases. Thus, for example, it is possible to prevent falling off of the panel member even in a case where the panel member is wiped down for cleaning and load works on the panel member, which moves the panel member.

In the second holding part, the attraction surface of the panel-side magnetic material and the attraction surface of the function-unit-side magnetic material are in contact by surfaces with each other, so that it is possible to easily slide the panel member in a direction (herein, front-back direction and/or up-and-down direction) that is parallel to the attraction surfaces. Thus, for example, a contractor is able to slide the panel member with respect to the function unit or the like in the front-back direction or the up-and-down direction in a state where the panel member is held by the function unit or the like, in other words, it is possible to facilitate positioning of the panel member.

In the function unit, a surface on which the function-unit-side magnetic material is arranged is formed to be along a perpendicular surface in the front-back direction, the function-unit-side magnetic material is attached to the function unit so as to be along the perpendicular surface. Thus, in the second holding part, the attraction surface of the panel-side magnetic material and the attraction surface of the function-unit-side magnetic material are in contact by surfaces with each other along the perpendicular direction, so that it is possible to more easily slide the panel member in a direction (for example, front-back direction or up-and-down direction) that is parallel to the attraction surfaces. Thus, for example, a contractor is able to slide the panel member in the front-back direction or the up-and-down direction in a state where the panel member is held by the function unit or the like, so that it is possible to more easily adjust the panel member to an appropriate position.

According to one aspect of the embodiments, it is possible to allow a panel member to slide so as to facilitate positioning thereof while preventing falling off the panel member attached to a toilet body.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A flush toilet comprising:

a toilet body;

a body-side magnetic material with an attraction surface disposed at the toilet body;

a function unit arranged in a rear part of the toilet body;

a panel member covering a side surface of the function unit;

a panel-side magnetic material with an attraction surface disposed at the panel member; and a holding part including the body-side magnetic material and the panel-side magnetic material, wherein the holding part attracts and holds the toilet body and a side surface of the panel member by a magnetic force between the body-side magnetic material and the panel-side magnetic material, the panel member is curved toward the toilet body in a state where the panel member is attached to the toilet body, the attraction surface of the panel-side magnetic material and the attraction surface of the body-side magnetic material are plane-shaped, and the holding part further includes a protruding part protruding from the panel member toward the toilet body.

2. The flush toilet according to claim 1, wherein the holding part includes:

an upper holding part including a first protruding part with a first upper surface and a first lower surface; and a lower holding part that is arranged under the upper holding part and including a second protruding part with a second upper surface and a second lower surface, and a first difference between a width of the second upper surface and a width of the second lower surface of the second protruding part of the lower holding part is larger than a second difference between a width of the first upper surface and a width of the first lower surface of the first protruding part of the upper holding part.

3. The flush toilet according to claim 1, further comprising a plurality of holding parts, including the holding part, wherein the plurality of holding parts include a plurality of panel-side magnetic materials, including the panel-side magnetic material, and a plurality of body-side magnetic materials, including the body-side magnetic material, and respective attraction surfaces of the panel-side magnetic materials, including the attraction surface of the panel-side magnetic material, and respective attraction surfaces of the body-side magnetic materials, including the attraction surface of the body-side magnetic material, are plane-shaped.

4. The flush toilet according to claim 1, wherein the attraction surface of the panel-side magnetic material and the attraction surface of the body-side magnetic material are arranged parallel to one another in the state where the panel member is attached to the toilet body.

5. The flush toilet according to claim 1, wherein the attraction surface of the panel-side magnetic material and the attraction surface of the body-side magnetic material each are aligned along a vertical plane in a front-back direction of the flush toilet in the state where the panel member is attached to the toilet body.

6. The flush toilet according to claim 1, wherein the holding part is a first holding part attracting and holding a side surface of the toilet body and the side surface of the panel member with the magnetic force and further comprising a function-unit-side magnetic material with an attraction surface disposed at the function unit, and a second holding part attracting and holding the side surface of the function unit and the side surface of the panel member with another magnetic force between the function-unit-side magnetic material and the panel-side magnetic material, wherein the attraction surface of the panel-side magnetic material and the attraction surface of the function-unit-side magnetic material are plane-shaped, and a surface of the function unit for arranging the function-unit-side magnetic material is aligned along a vertical plane in a front-back direction of the flush toilet.

* * * * *